United States Patent [19]

Goldman

[11] Patent Number: 4,504,090

[45] Date of Patent: Mar. 12, 1985

[54] SWIVEL, TILT AND RECLINE ARM CHAIR

[76] Inventor: Paul R. Goldman, 8 Joyce Ter., Andover, Mass. 01810

[21] Appl. No.: 435,477

[22] Filed: Oct. 20, 1982

[51] Int. Cl.[3] ..... A47C 1/02

[52] U.S. Cl. ..... 297/342; 297/317; 297/318

[58] Field of Search ..... 297/342, 341, 349, 317, 297/318, 68, 250, 255, 458, 459, DIG. 2, 354, 355

[56] References Cited

U.S. PATENT DOCUMENTS

| | | | |
|---|---|---|---|
| 2,609,032 | 9/1952 | Cramer | 297/354 X |
| 3,891,267 | 6/1975 | Taylor | 297/349 |
| 3,975,050 | 8/1976 | McKee | 297/349 |

FOREIGN PATENT DOCUMENTS

| | | | |
|---|---|---|---|
| 708283 | 4/1931 | France | 297/342 |
| 726797 | 3/1932 | France | 297/342 |
| 1034827 | 4/1953 | France | 297/342 |
| 1175336 | 11/1958 | France | 297/342 |
| 1255403 | 1/1960 | France | 297/342 |
| 2458251 | 2/1981 | France | 297/342 |

*Primary Examiner*—James T. McCall

*Attorney, Agent, or Firm*—Pearson & Pearson

[57] ABSTRACT

An upholstered arm chair is capable of swivelling, tilting, rocking and reclining by reason of the provision of a U shaped arm rest body having a central platform with arm rests on each opposite side and supported at about seat level, on swivel and tilt mechanism, above floor level. A chair seat overlies the central platform and is slidable forwardly and rearwardly by followers in tracks on the arm rests and a back rest is pivotally connected to the chair seat by mechanical linkage to move to recline position as the seat moves forwardly and vice versa. A knob and set screw locks the followers in selected positions.

3 Claims, 6 Drawing Figures

SWIVEL, TILT AND RECLINE ARM CHAIR

BACKGROUND OF THE INVENTION

Swivel arm chairs, of the upholstered type are well known, especially for office use as executive chairs and usually consist of an upholstered chair seat and chair back with upholstered arm rests all fixed to each other and supported on a conventional spring actuated swivel pedestal, with four legs, so that the occupant can swivel around on the vertical axis of the pedestal or tilt rearwardly against spring compression. However, the chair back and chair seat are fixed so that even when the chair is tilted rearwardly, there is no reclining position such as achieved by chairs which are sold as recliners.

SUMMARY OF THE INVENTION

In this invention the conventional swivel and tilt pedestal and legs is used, but in addition, a recline position is achieved wherein the chair seat moves forwardly as the back rest pivots rearwardly until a reclining position is obtained in addition to the swivel, tilt, or rock of conventional arm chairs.

The reclining position is achieved by providing a platform which is supported by the swivel-tilt pedestal, and a chair seat which is supported by followers slidable in inclined tracks on the inside faces of the upstanding side walls of the arm rest body. The back rest is pivotally connected to the chair seat to pivot rearwardly as the seat slides forwardly and to pivot forwardly to normal, erect, back-supporting position, when the seat slides rearwardly to normal retracted position. A knurled knob and threaded set screw on the outside of one of the side walls permits the occupant to lock the followers in any selected location along the tracks to achieve desired reclining angles of the back rest.

DESCRIPTION OF A PREFERRED EMBODIMENT

Figure 1:
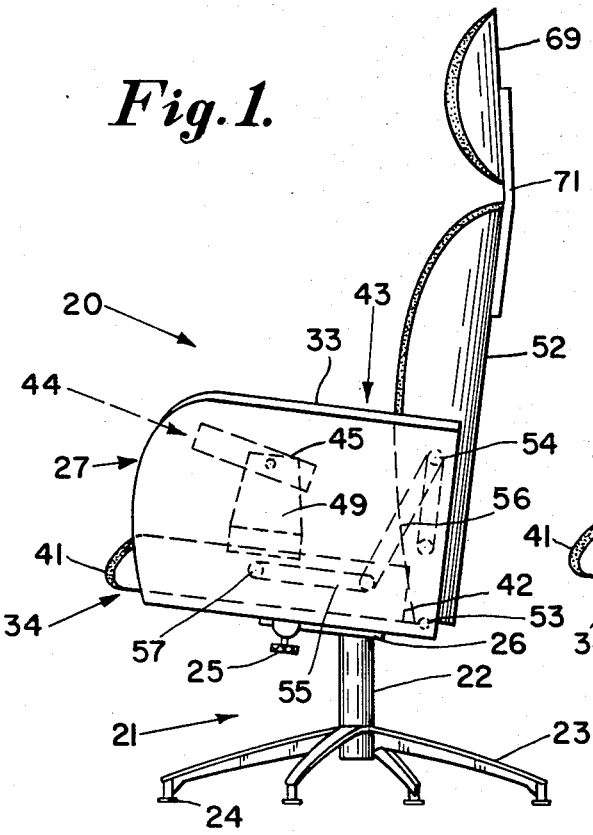
FIG. 1 is a diagrammatic side elevation of the arm chair of the invention showing the recline mechanism in normal position in dotted lines.
Figure 2:
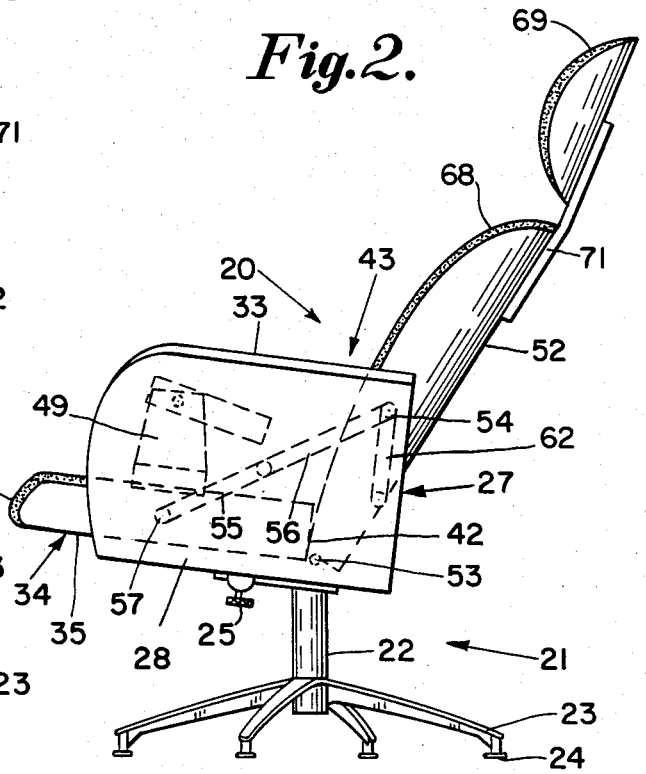
FIG. 2 is a view similar to FIG. 1 showing the recline mechanism in reclined position in dotted lines.
Figure 3:
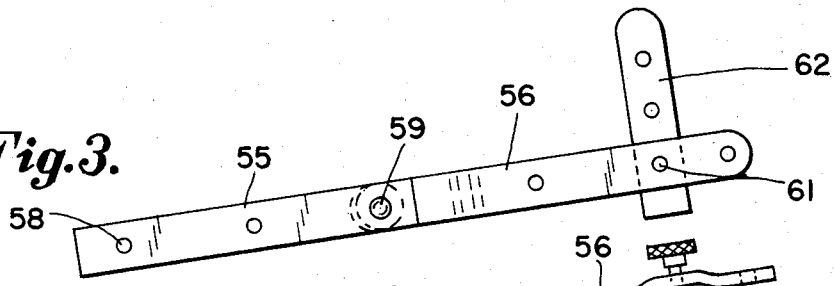
FIG. 3 is an enlarged side elevation.
Figure 4:
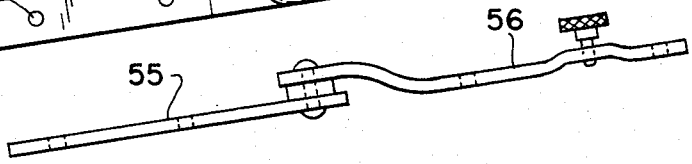
FIG. 4 is an enlarged top plan view of the mechanical linkage of the recline mechanism.
Figure 5:
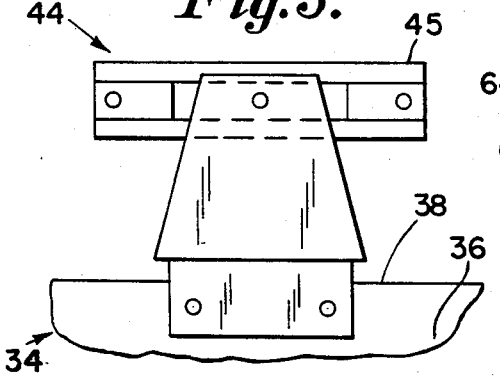
FIG. 5 is an enlarged side elevation.
Figure 6:
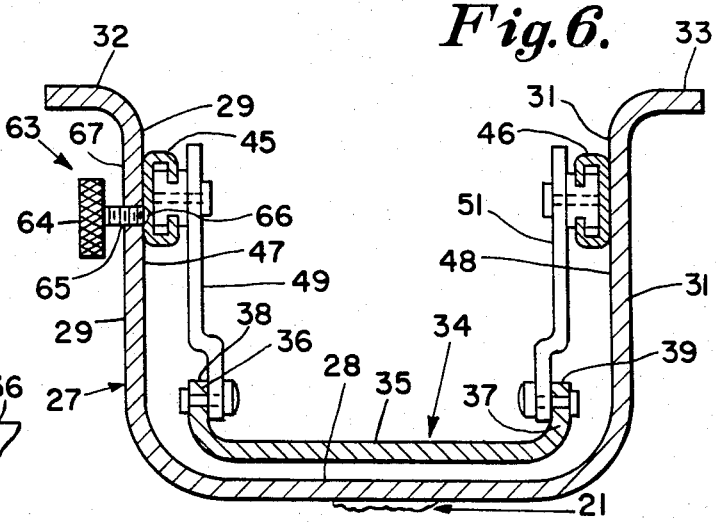
FIG. 6 is an enlarged fragmentary front elevation of the track, follower and set screw mechanism of the invention in half section.

As shown in FIGS. 1 and 2, the arm chair 20, includes the swivel and tilt mechanism 21 consisting of a central pedestal 22, four legs such as 23, casters such as 24, and conventional cradle, compression spring, adjusting knob assembly 25, which may be of any type, well known in the art.

The swivel and tilt mechanism 21, supports at the top 26 of the pedestal 22, a one piece, U shaped arm rest, body 27 which includes the central, normally substantially horizontal platform 28 with its pair of integral upwardly extending oppositely disposed side walls 29 and 31 each of which terminates in an outwardly curved, generally horizontal arm rest 32 or 33 adapted to support the arms of an occupant.

A chair seat 34 is provided, preferably of U shape and having a horizontal seat portion 35 which overlies the platform 28 and an upwardly curved side portion 36 or 37 on each opposite side thereof each terminating in an upper edge portion 38 or 39. Seat 34 also has a front edge 41 and a rear edge 42.

Recline mechanism 43 includes means 44 supporting chair seat 34 with the seat portion 35 overlying the platform 28 at a spaced distance thereabove for sliding forward and rearward movement relative to the platform. Means 44 includes a pair of tracks 45 and 46, each on an opposite side of the chair, and affixed to the inside face 47 or 48 of an upstanding side wall 29 or 31 of body 27 preferably at an incline of about 30° from the horizontal. Means 44 also includes a pair of followers 49 and 51, each slidable in one of the tracks 46 or 46 at the upper end and each having its lower end attached to the upper edge portion 38 or 39 of the adjacent side portion 36 or 37 of the seat 34 so that the seat rises from the platform as it moves forwardly and so that gravity tends to return the seat to normal retracted position, of FIG. 1.

A back rest 52 is pivoted at its lower edge 53 to the rear edge 42 of chair seat 34 and its intermediate portion 54 is connected by mechanical pivoted links 55 and 56 to an intermediate portion 57 of chair seat 34. The pivot points of the linkage means are indicated at 58, 59, and 61 and braces such as 62 are shown which are immovably affixed to the side walls of the body 27 to lend strength to the structure.

Threaded means 63 includes the knob 64, and threated shaft 65 which extends through one of the side walls 29 or 31 into one of the tracks 45 or 46 so that its tip 66 engages the follower 49 or 51 in that track to selectively and frictionally lock the follower in any desired position of recline. Means 63 is on the outside 67 of the side wall of the body 27 so as to be accessible to the occupant of the chair for manipulation.

It will be understood that arm chair 20 is upholstered as at 68 and preferably includes the head support 69 connected by a pair of braces such as 71 to support the head of the user in the reclining position of FIG. 2.

I claim:

1. In an arm chair, the combination of:

A U shaped arm rest body including a normally, substantially horizontal, central, platform and a pair of upstanding side walls each with an arm rest, each on an opposite side of said central platform and adapted to support the arms of an occupant;

swivel and tilt mechanism, supporting said central platform at about seat level above floor level for selective tilting or swivelling of said arm rest body;

a chair seat overlying said central platform of said arm rest body;

means supporting said chair seat from said upstanding side walls of said body for forward and rearward sliding movement; including a pair of tracks each on an opposite inside face of one of said upstanding side walls, each at an angle of about 30° from the horizontal and each having a follower slidable therein and attached to one of the opposite sides of said chair seat;

a back rest having a lower edge pivotally connected to the rearward edge of said chair seat and adapted to support the back of said occupant of said chair;

linkage means connecting an intermediate portion of said chair seat to an intermediate portion of said back rest so that forward movement of said seat moves said back rest rearwardly to reclining position and rearward movement of said seat moves said back rest forwardly to normal erect position; and threaded means for locking said seat and said back rest in selected positions said threaded means comprising at least one set screw having a handle knob accessible from the outside face of one of said side walls of said body and having a tip extending through said side wall into contact with the follower of one of said tracks to frictionally lock said follower against said track.

2. A swivel, tilt and recline arm chair comprising:

a one piece, U-shaped, body having a central, substantially horizontal platform with an integral, upstanding, side wall and horizontal arm rest on each opposite side thereof;

swivel and tilt mechanism supporting said central platform at seat level above the floor;

a chair seat overlying said platform; and recline mechanism including a pair of oppositely disposed tracks, each on the inside surface of one of the upstanding side walls of said body, a pair of followers, each slidable in one of said tracks and supporting one side of said chair seat at a spaced distance above said platform for forward and rearward movement relative thereto, a back rest having a lower edge pivotally connected to the rear edge of said chair seat, and mechanical linkage connecting said back rest to said chair rest so that when said chair seat meoves forwardly, said back rest moves rearwardly to recline position, and vice versa;

said recline mechanism including a threaded set screw operable by a knob on the outside of one of said side walls for frictionally locking one of said followers in a selected location along its track.

3. In an arm chair, the combination of:

a one piece U shaped arm rest body including a normally, substantially horizontal, central, platform and a pair of upstanding side walls each terminating in an outwardly curved generally horizontal arm rest, each on an opposite side of said central platform and adapted to support the arms of an occupant;

swivel and tilt mechanism, supporting said central platform at about seat level above floor level for selective tilting or swivelling of said arm rest body;

a U shaped chair seat having a horizontal seat portion overlying said central platform of said arm rest body and having an upwardly extending side portion on each opposite side thereof, and a rearward edge;

means supporting said chair seat from said upstanding side walls of said body for forward and rearward sliding movement;

said chair seat support means including a pair of tracks, each on an opposite inside face of one of said upstanding side walls of said body, each extending at an angle of about 30° from the horizontal, and each having a follower slidable therein and each having a lower end attached to one of the upwardly extending side portions of said chair seat for supporting the same in forward and rearward sliding movement;

a back rest having a lower edge pivotally connected to the rearward edge of said chair seat and adapted to support the back of said occupant of said chair;

linkage means connecting an intermediate portion of said chair seat to an intermediate portion of said back rest so that forward movement of said seat moves said back rest rearwardly to reclining position and rearward movement of said seat moves said back rest forwardly to normal erect position; and threaded means for locking said seat and said back rest in selected positions.

* * * * *